US010852065B2

(12) United States Patent
Lahtinen et al.

(10) Patent No.: US 10,852,065 B2
(45) Date of Patent: Dec. 1, 2020

(54) METHOD FOR CONTROLLING THE SUSPENSION IN A SUSPENSION SMELTING FURNACE

(71) Applicant: Outotec (Finland) Oy, Espoo (FI)

(72) Inventors: Markku Lahtinen, Espoo (FI); Lauri P. Pesonen, Helsinki (FI); Tapio Ahokainen, Helsinki (FI); Peter Bjorklund, Espoo (FI)

(73) Assignee: Outotec (Finland) Oy, Espoo (FI)

( * ) Notice: Subject to any disclaimer, the term of this patent is extended or adjusted under 35 U.S.C. 154(b) by 232 days.

(21) Appl. No.: 15/593,593

(22) Filed: May 12, 2017

(65) Prior Publication Data

US 2017/0248368 A1 Aug. 31, 2017

Related U.S. Application Data

(63) Continuation-in-part of application No. 14/353,082, filed as application No. PCT/FI2011/051055 on Nov. 29, 2011, now Pat. No. 9,677,815.

(51) Int. Cl.
*F27D 19/00* (2006.01)
*F27B 1/16* (2006.01)
(Continued)

(52) U.S. Cl.
CPC ..... *F27D 19/00* (2013.01); *F27B 1/16* (2013.01); *F27B 1/20* (2013.01); *F27B 1/26* (2013.01);
(Continued)

(58) Field of Classification Search
CPC ... F27D 9/00; F27D 3/16; F27D 19/00; F27D 3/0033; F27D 3/14; F27B 1/16; F27B 1/20; F27B 1/26
See application file for complete search history.

(56) References Cited

U.S. PATENT DOCUMENTS 2,506,577 A * 5/1950 Calkins ..... A01B 39/19 172/39
3,674,463 A 7/1972 Yannopoulos
(Continued)

FOREIGN PATENT DOCUMENTS

AL 98/14741 A1 4/1998
EP 0 153 914 9/1985
(Continued)

OTHER PUBLICATIONS

International Search Report prepared by the National Board of Patents and Registration of Finland for PCT/FI2011/051055 dated Mar. 7, 2012, 3 pages.
(Continued)

*Primary Examiner* — Scott R Kastler
(74) *Attorney, Agent, or Firm* — Chernoff Vilhauer LLP

(57) ABSTRACT

The invention relates to a method for controlling suspension in a suspension smelting furnace. The method comprises feeding additionally to pulverous solid matter and additionally to reaction gas reducing agent into the suspension smelting furnace, wherein reducing agent is fed in the form of a concentrated stream of reducing agent through the suspension in the reaction shaft onto the surface of the melt to form a reducing zone containing reducing agent within the collection zone of the melt.

4 Claims, 5 Drawing Sheets

(51) Int. Cl.

| | |
|---|---|
| ***F27B 1/20*** | (2006.01) |
| ***F27D 3/00*** | (2006.01) |
| ***F27D 3/14*** | (2006.01) |
| ***F27D 3/16*** | (2006.01) |
| ***F27B 1/26*** | (2006.01) |

(52) U.S. Cl.

CPC ..... *F27D 3/0033* (2013.01); *F27D 3/14* (2013.01); *F27D 3/16* (2013.01); *F27D 2019/0068* (2013.01); *F27D 2019/0075* (2013.01)

(56) References Cited

U.S. PATENT DOCUMENTS

| | | | | |
|---|---|---|---|---|
| 6,238,457 | B1 | 5/2001 | Holmi et al. | |
| 6,887,298 | B1 * | 5/2005 | Kojo | C22B 15/0052 75/585 |
| 8,986,421 | B2 | 3/2015 | Sipilä | |
| 9,677,815 | B2 * | 6/2017 | Lahtinen | C22B 15/0028 |
| 2013/0328250 | A1 | 12/2013 | Myyri et al. | |
| 2014/0239560 | A1 | 8/2014 | Lahtinen et al. | |
| 2017/0248368 | A1 * | 8/2017 | Lahtinen | F27D 19/00 |

FOREIGN PATENT DOCUMENTS

| | | | |
|---|---|---|---|
| FI | 100889 | B | 3/1998 |
| GB | 1243568 | A | 8/1971 |
| JP | 58221241 | A | 12/1983 |
| JP | H09-316562 | | 12/1997 |
| JP | 2002-363659 | | 12/2002 |
| JP | 2003129146 | A | 5/2003 |
| KR | 2000-0048734 | A | 7/2000 |
| WO | 00/70103 | A1 | 11/2000 |
| WO | 00/70104 | A1 | 11/2000 |
| WO | 2011/048263 | A1 | 4/2011 |

OTHER PUBLICATIONS

Notice of Grounds for Rejection prepared by the Korean Intellectual Property Office for KR 2014-7016471, dated Aug. 18, 2014, 8 pages.

Notification of Reason of Refusal prepared by the Japanese Patent Office for JP 2014-543946, dated Apr. 28, 2015, 11 pages.

Supplementary European Search Report issued by the European Patent Office for EP 11876769 dated Nov. 5, 2015, 11 pages.

* cited by examiner

METHOD FOR CONTROLLING THE SUSPENSION IN A SUSPENSION SMELTING FURNACE

CROSS-REFERENCE TO RELATED APPLICATIONS

This application is a continuation-in-part of U.S. patent application Ser. No. 14/353,082, filed Apr. 21, 2014, now U.S. Pat. No. 9,677,815, issued Jun. 13, 2017, which is a national stage application filed under 35 USC 371 based on International Application No. PCT/FI2011/051055 filed Nov. 29, 2011.

STATEMENT REGARDING FEDERALLY SPONSORED RESEARCH OR DEVELOPMENT

Not Applicable.

THE NAMES OF THE PARTIES TO A JOINT RESEARCH AGREEMENT

Not Applicable.

INCORPORATION-BY-REFERENCE OF MATERIAL SUBMITTED ON A COMPACT DISC OR AS A TEXT FILE VIA THE OFFICE ELECTRONIC FILING SYSTEM (EFS-WEB)

Not Applicable.

STATEMENT REGARDING PRIOR DISCLOSURES BY THE INVENTOR OR A JOINT INVENTOR

Not Applicable.

BACKGROUND OF THE INVENTION

The invention relates to a method that takes place in a suspension smelting furnace, such as a flash smelting furnace, and to a suspension smelting furnace, such as a flash smelting furnace, and to a concentrate burner for feeding reaction gas and pulverous solid matter into the reaction shaft of suspension smelting furnace such as a flash smelting furnace.

A suspension smelting furnace comprises usually three main parts: a reaction shaft, a lower furnace, and an uptake. In a suspension smelting process, pulverous solid matter, which comprises sulphidic concentrate, slag forming agent and other pulverous components, is mixed with reaction gas by means of a concentrate burner in the upper part of the reaction shaft to form suspension of pulverous solid matter and reaction gas in the reaction shaft. The reaction gas can be air, oxygen or oxygen-enriched air. The suspension formed in the reaction shaft falls to the lower furnace where the suspension forms a melt having two or three different layer phases. The lowest layer can be a metal layer such as a layer of blister copper, with either a matte layer or directly a slag layer directly on it. Usually the lowest is a matte layer with a slag layer directly on it.

In suspension smelting the final phase equilibrium between slag and matte only arises during the slag reactions taking place in the lower furnace. In other words, the potentially imbalanced over- and under-oxidized compounds formed in the reaction shaft still react with each other in the slag phase, particularly in the primary discharge point of the shaft suspension under the reaction shaft, so that the massive slag and matte phase are almost in the composition defined by their thermodynamic composition. In addition to the previously mentioned equilibrium-determining copper already dissolved in the slag, copper-rich matte, indissoluble to the slag, remains in the slag as a mechanical suspension, which does settle to the matte layer completely in a realistic time.

The formation of magnetite in the slag increases the viscosity of the slag and slows down the separation of molten matte particles contained in the slag.

It is known before to use reducing agents such as coke to slow down the formation of magnetite in the slag.

Japanese patent application 58-221241 presents a method, in which coke breeze or coke breeze together with pulverized coal are charged into the reaction shaft of a flash smelting furnace through a concentrate burner. The coke is fed into the furnace so that the entire surface of the melt in the lower furnace is evenly covered with the unburnt powder coke. According to the application, the degree of reduction of magnetite decreases when the grain size is ultra-fine, so grain size used is preferably from 44 μm to 1 mm. The slag layer covered by unburnt coke, which remains on the molten slag bath, decreases considerably the partial pressure of oxygen at the slag phase. The highly reducing atmosphere arising from the coke layer causes for example damages to the lining of the furnace.

Publication WO 00/70103 presents a method and equipment, whereby matte with a high non-ferrous metal content and disposable slag are produced simultaneously in a suspension-smelting furnace from non-ferrous sulphide concentrate. According to the invention, a carbonaceous reducing agent is charged to the lower furnace of a suspension smelting furnace via tuyeres to the part of the furnace which has a reduced cross-sectional area.

BRIEF SUMMARY OF THE INVENTION

The object of the invention is to provide an improved method, suspension smelting furnace, and concentrate burner for limiting the formation of magnetite in slag in the lower furnace of a suspension smelting furnace during the suspension smelting process.

Another object of the invention is to provide an improved method, suspension smelting furnace, and concentrate burner for controlling temperature of the suspension in the reaction shaft.

The invention relates also to the use of the method or the suspension smelting furnace or the concentrate burner for reducing magnetite in smelt by adjusting the amount of fed reaction gas to the amount of fed reducing agent to form sub-stoichiometric in the reaction shaft of the suspension smelting furnace. By creating sub-stoichiometric conditions in the reaction shaft, the reduction agent functions as a reducing agent at least partly preventing formation of magnetite in the slag.

The invention is based on that by feeding reducing agent in the form of a concentrated stream of reducing agent onto the surface of the melt to form a reducing zone within the collection zone, the concentrated stream of reducing agent creates waves in the surface of the melt that effectively spreads the reducing zone.

By feeding reducing agent in the form of a concentrated stream of reducing agent onto the surface of the melt to form a reducing zone within the collection zone, the effect of the reducing agent will be good, because this leads to the reducing agent being effectively mixed with the magnetite forming components of the suspension that is added to the melt.

In a preferred embodiment of the method pulverous solid matter and reaction gas is fed into the reaction shaft by means of the concentrate burner so that suspension produced by pulverous solid matter and reaction gas forms a suspension jet in the suspension shaft, wherein the suspension jet widens in the reaction shaft in the direction of the lower furnace and wherein the suspension jet has an imaginary vertical central axis. In this preferred embodiment of the method a concentrated stream of reduction agent is fed by means of the concentrate burner so that said concentrated stream of reducing agent is fed essentially in the direction of the imaginary vertical central axis of the suspension jet and in the vicinity to the imaginary vertical central axis of the suspension to at least partly prevent reducing agent of the concentrated stream of reducing agent from reacting with reaction gas prior landing on the surface of the melt. In this embodiment reducing agent of the concentrated stream of reducing agent is at least partly prevented from reacting with reaction gas prior landing on the surface of the melt, because the reaction gas content is lower in the vicinity to the imaginary vertical central axis of a such suspension jet than outside the suspension jet. In this preferred embodiment of the method, the concentrated stream of reduction agent is fed by means of the concentrate burner at an initial feeding velocity that is at least twice the initial feeding velocity of the reaction gas to avoid backfiring.

In a preferred embodiment of the suspension smelting furnace, the concentrate burner of the suspension smelting furnace is arranged for feeding pulverous solid matter and reaction gas into the reaction shaft so that suspension produced by pulverous solid matter and reaction gas forms a suspension jet in the suspension shaft, which the suspension jet widens in the reaction shaft in the direction of the lower furnace and which the suspension jet has an imaginary vertical central axis. In this preferred embodiment, the concentrate burner is provided with a reducing agent feeding means for feeding a concentrated stream of reducing agent essentially in the direction of the imaginary vertical central axis of the suspension jet and in the vicinity to the imaginary vertical central axis of the suspension jet to at least partly prevent reducing agent of the concentrated stream of reducing agent from reacting with reaction gas prior landing on the surface of the melt, because the reaction gas content is lower in the vicinity to the imaginary vertical central axis of a such suspension jet than outside the suspension jet. In this preferred embodiment of the suspension smelting furnace, the concentrate burner is preferably provided with a reduction agent feeding means for feeding the concentrated stream of reduction agent an initial feeding velocity that is at least twice the initial feeding velocity of the reaction gas to avoid backfiring.

The invention relates also to the use of the method or the suspension smelting furnace or the concentrate burner for controlling thermal balance in the reaction shaft of a suspension smelting furnace by adjusting the amount of fed reaction gas to the amount of fed reducing agent to form over-stoichiometric in the reaction shaft of the suspension smelting furnace. By creating over-stoichiometric in the reaction shaft of the suspension smelting furnace, the reducing agent produces thermal energy in the reaction shaft which can be used for controlling the temperature of the suspension in the reaction shaft.

BRIEF DESCRIPTION OF THE SEVERAL VIEWS OF THE DRAWINGS

In the following the invention will be described in more detail by referring to the figures, of which

DETAILED DESCRIPTION OF THE INVENTION

Figure 1:
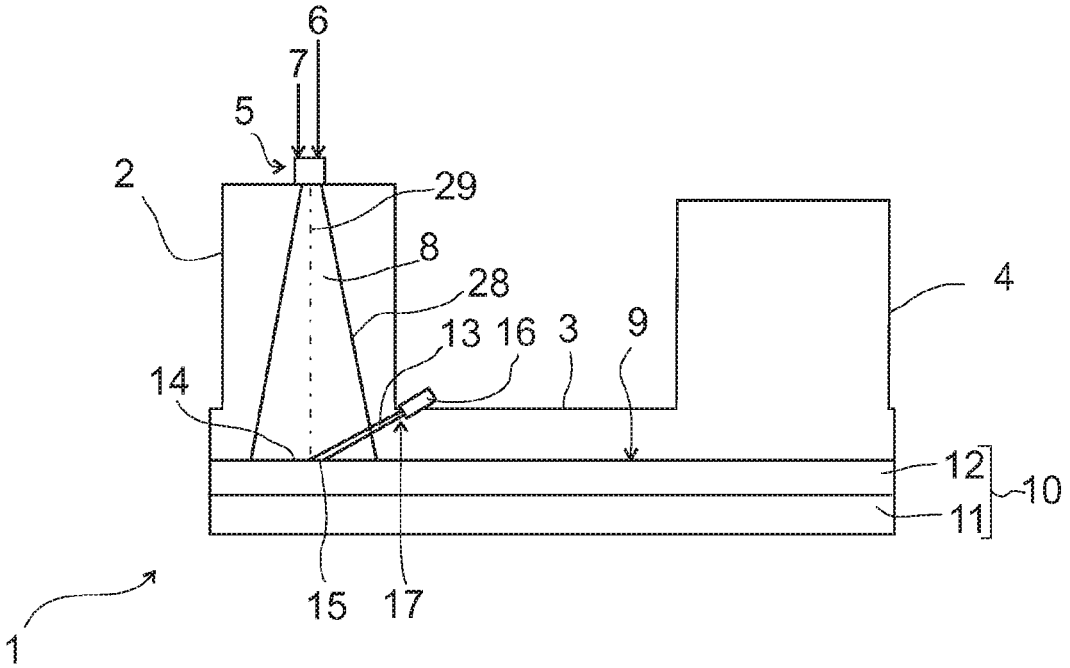
FIG. 1 is a schematic representation of a suspension smelting furnace according to a first preferred embodiment.

First the method for controlling suspension in a suspension smelting furnace and preferred and alternative embodiments of the method will be described in greater detail.

The method comprises using a suspension smelting furnace 1 comprising a reaction shaft 2 and a lower furnace 3 at the lower end of the reaction shaft 2 and a concentrate burner 5 at the top of the reaction shaft 2. The suspension smelting furnace 1 shown in FIGS. 1 to 5 also comprises an uptake 4.

The method comprises using a concentrate burner 5 that comprises a pulverous solid matter supply device 18 for feeding pulverous solid matter 6 into the reaction shaft 2 and that comprises a gas supply device (24) for feeding reaction gas 7 into the reaction shaft 2 to produce a suspension 8 of pulverous solid matter 6 and reaction gas 7 in the reaction shaft 2.

The method comprises feeding pulverous solid matter 6 and reaction gas 7 into the reaction shaft 2 by means of the concentrate burner 5 to produce a suspension 8 of pulverous solid matter 6 and reaction gas 7 in the reaction shaft 2.

The method comprises collecting suspension 8 in the lower furnace 3 on the surface 9 of a melt 10 in the lower furnace 3, so that suspension 8 that lands on the surface 9 creates a collection zone 14 at the surface 9 of a melt 10 in the lower furnace 3. In FIGS. 1 to 5 a melt 10 having a matte layer 11 and a slag layer 12 on top of the matte layer is shown.

The operating principle of a such suspension smelting furnace is known for example from publication U.S. Pat. No. 6,238,457.

The method comprises feeding additionally to pulverous solid matter 6 and additionally to reaction gas 7 reducing agent 13 into the suspension smelting furnace 1 so that reducing agent 13 is fed in the form of a concentrated stream of reducing agent 13 through the suspension 8 in the reaction shaft 2 onto the surface 9 of the melt 10 to form a reducing zone 15 containing reducing agent 13 within the collection zone 14 of the melt 10.

The method may comprise a step for arranging a reducing agent feeding means 16 at least partly inside the suspension smelting furnace 1, wherein the reducing agent feeding means 16 comprising a nozzle 17 that opens into the suspension smelting furnace 1, and a step for feeding the concentrated stream of reducing agent 13 through the nozzle 17 of the reducing agent feeding means 16 onto the surface 9 of the melt 10 to form a reducing zone 15 containing reducing agent 13 within the collection zone 14 of the melt 10.

In FIG. 1 a concentrated stream of reducing agent 13 is fed from the inside of the suspension smelting furnace 1, more precisely from the inside of the lower furnace 3 of the suspension smelting furnace 1, onto the surface 9 of the melt 10 to form a reducing zone 15 containing reducing agent 13 within the collection zone 14 of the melt 10. The method illustrated in FIG. 1 may comprise a step for arranging a reducing agent feeding means 16 at least partly inside the lower furnace 3 of the suspension smelting furnace 1, wherein the reducing agent feeding means 16 comprising a nozzle 17 that opens into the suspension smelting furnace 1, and a step for feeding the concentrated stream of reducing agent 13 through the nozzle 17 of the reducing agent feeding means 16 onto the surface 9 of the melt 10 to form a reducing zone 15 containing reducing agent 13 within the collection zone 14 of the melt 10.

Figure 2:
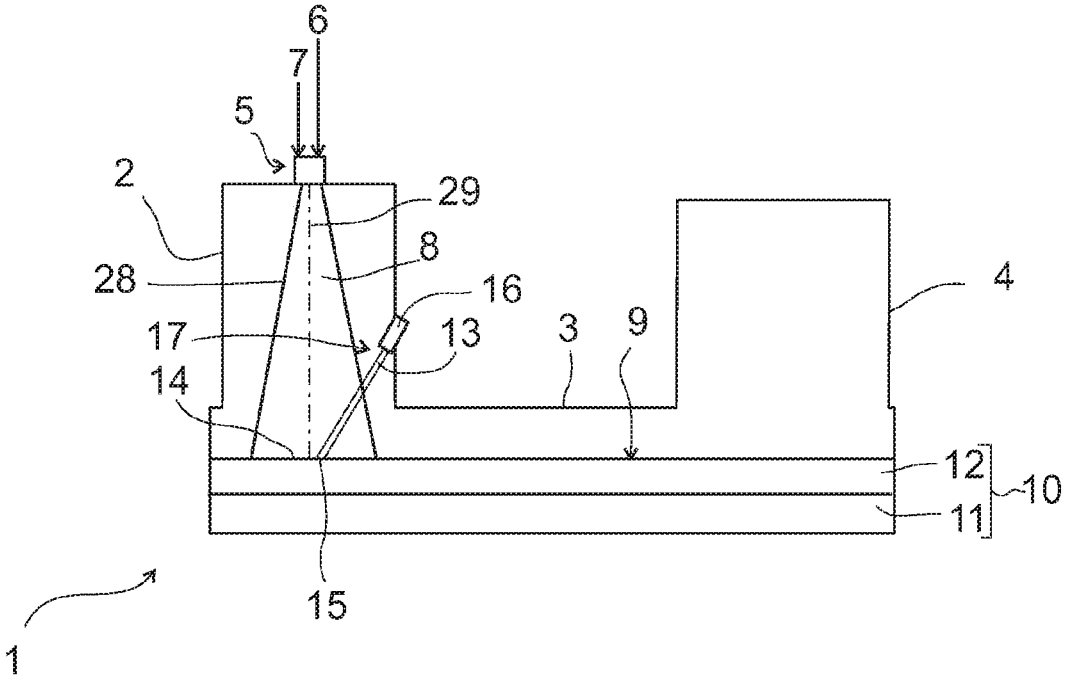
FIG. 2 is a schematic representation of a suspension smelting furnace according to a second preferred embodiment.

In FIG. 2 a concentrated stream of reducing agent 13 is fed from the inside of the reaction shaft 2 of the suspension smelting furnace 1 onto the surface 9 of the melt 10 to form a reducing zone 15 containing reducing agent 13 within the collection zone 14 of the melt 10. The method illustrated in FIG. 2 may comprise a step for arranging a reducing agent feeding means 16 at least partly inside the reaction shaft 2 of the suspension smelting furnace 1, wherein the reducing agent feeding means 16 comprising a nozzle 17 that opens into the suspension smelting furnace 1 and a step for feeding the concentrated stream of reducing agent 13 through the nozzle 17 of the reducing agent feeding means 16 onto the surface 9 of the melt 10 to form a reducing zone 15 containing reducing agent 13 within the collection zone 14 of the melt 10.

Figure 3:
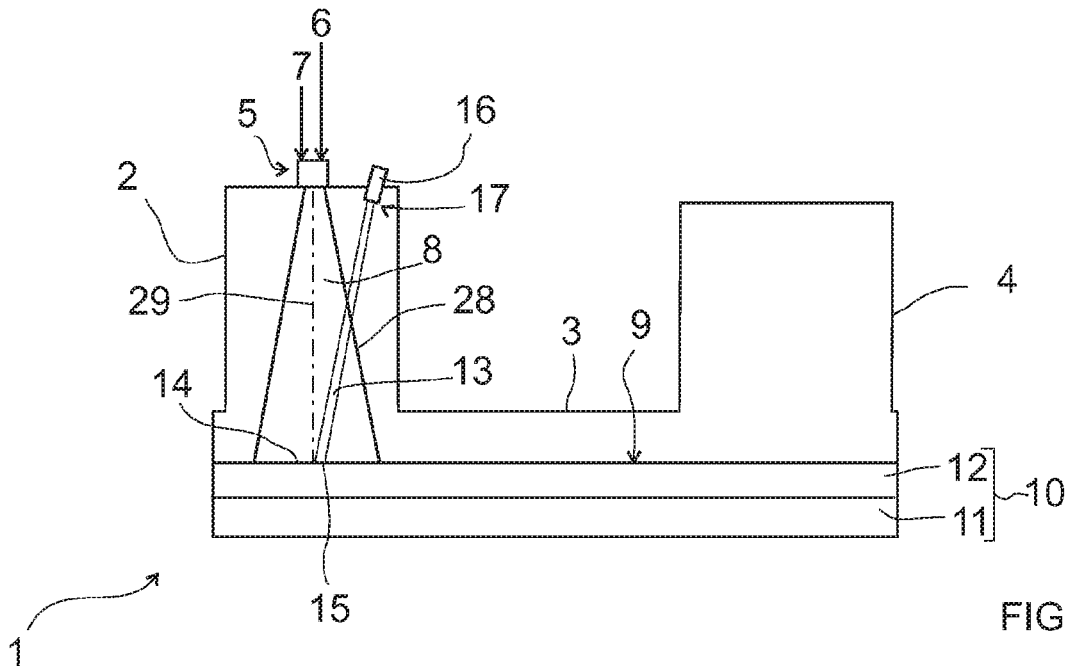
FIG. 3 is a schematic representation of a suspension smelting furnace according to a third preferred embodiment.

In FIG. 3 a concentrated stream of reducing agent 13 is fed from the inside of the reaction shaft 2 of the suspension smelting furnace 1 so that a concentrated stream of reducing agent 13 is fed from the top of the reaction shaft 2 onto the surface 9 of the melt 10 to form a reducing zone 15 containing reducing agent 13 within the collection zone 14 of the melt 10. The method illustrated in FIG. 3 may comprise a step for arranging a reducing agent feeding means 16 at the top of the reaction shaft 2, inside the reaction shaft 2 of the suspension smelting furnace 1, wherein the reducing agent feeding means 16 comprising a nozzle 17 that opens into the suspension smelting furnace 1, and a step for feeding the concentrated stream of reducing agent 13 through the nozzle 17 of the reducing agent feeding means 16 onto the surface 9 of the melt 10 to form a reducing zone 15 containing reducing agent 13 within the collection zone 14 of the melt 10.

Figure 4:
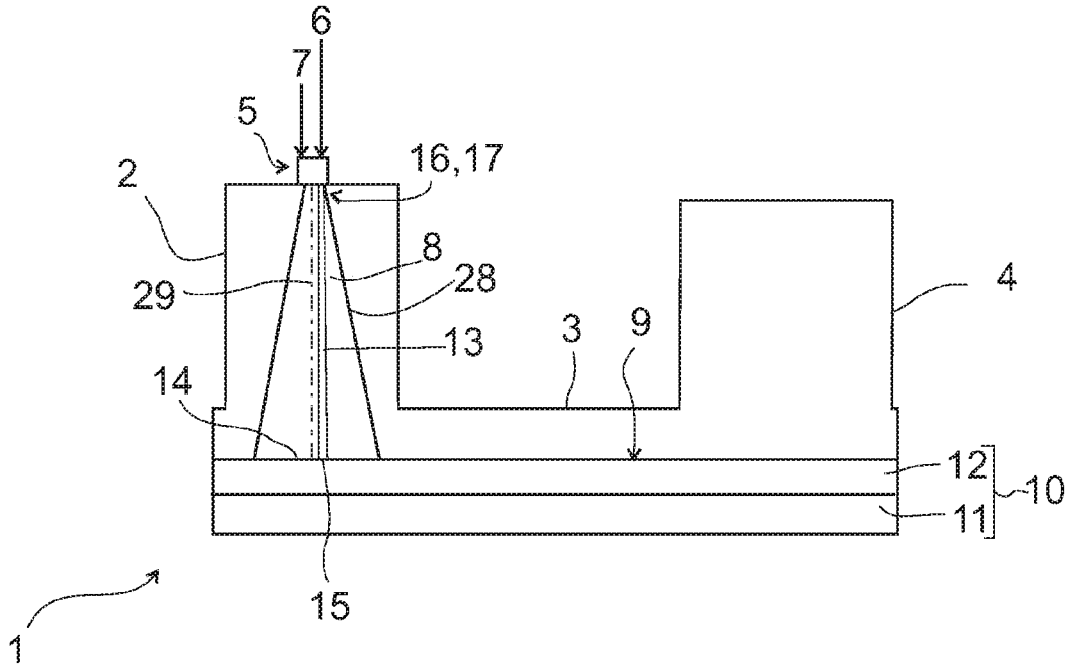
FIG. 4 is a schematic representation of a suspension smelting furnace according to a fourth preferred embodiment.
Figure 5:
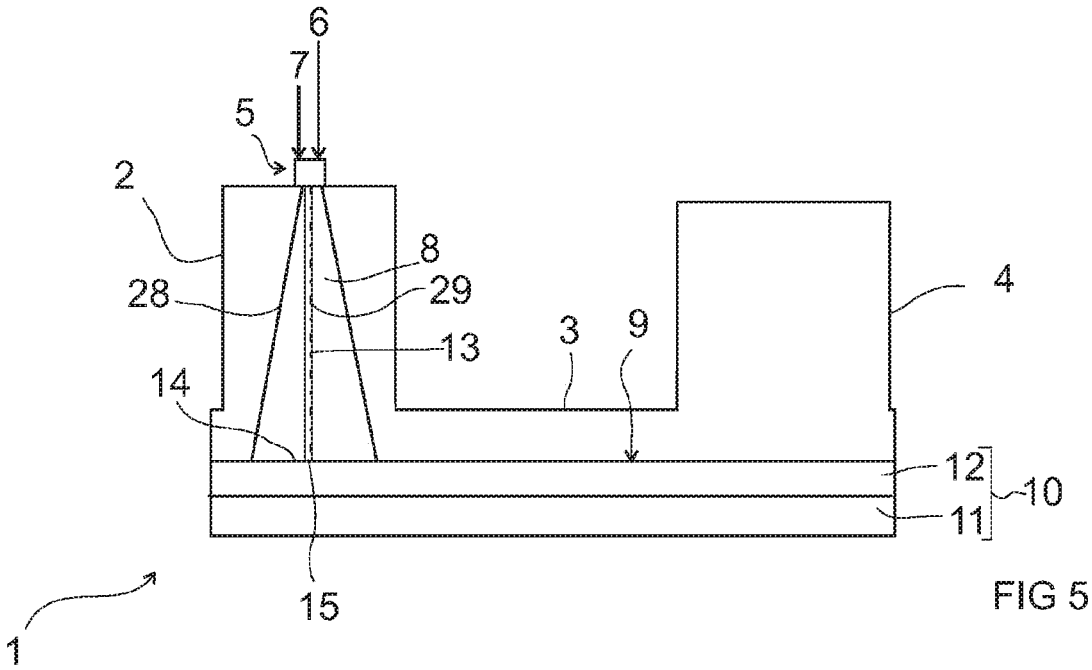
FIG. 5 is a schematic representation of a suspension smelting furnace according to a fifth preferred embodiment.
Figure 6:
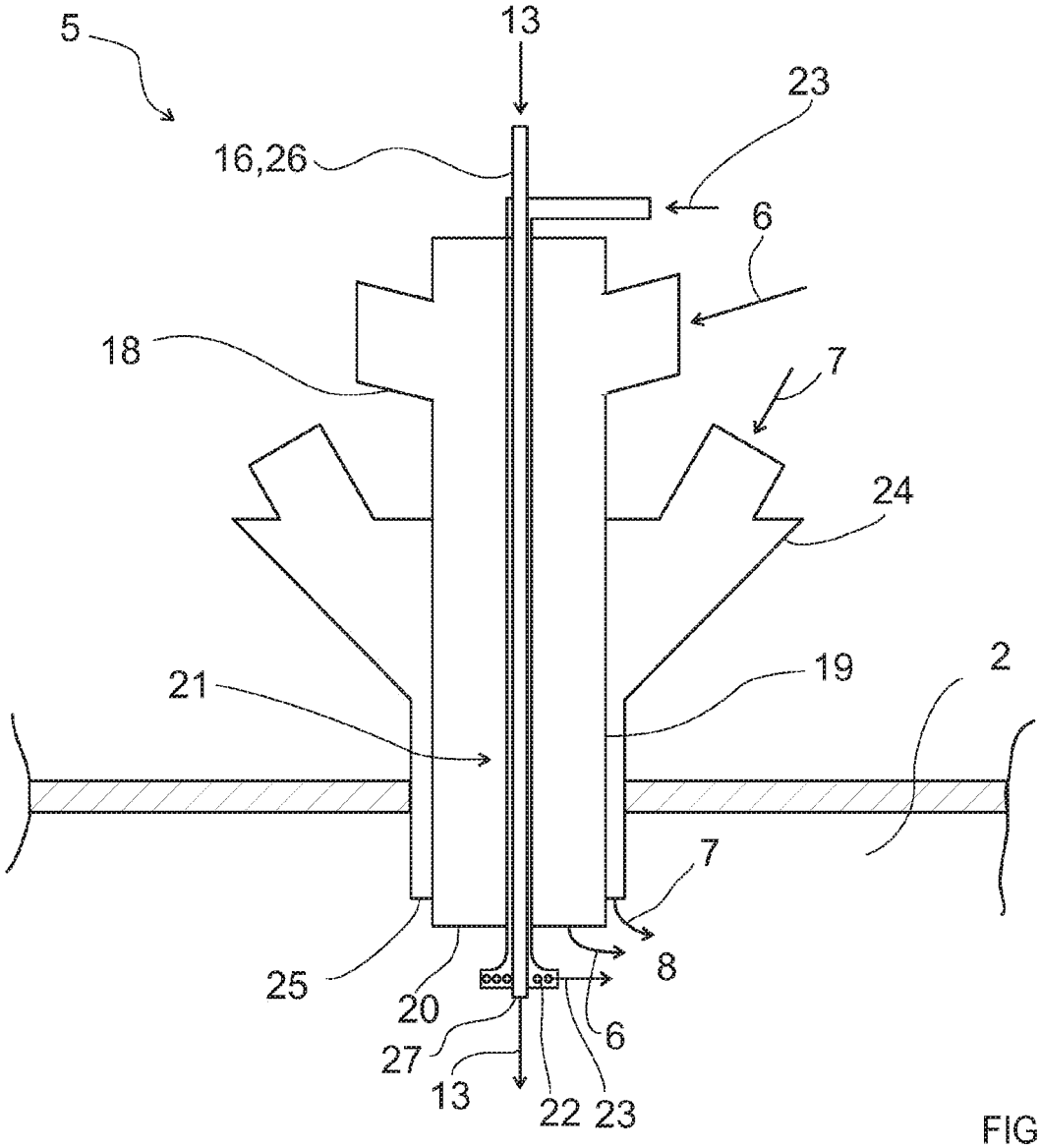
FIG. 6 is a schematic representation of a concentrate burner for a suspension smelting furnace according to a first preferred embodiment.

In FIG. 4 a concentrated stream of reducing agent 13 is fed by means of the concentrate burner 5 onto the surface 9 of the melt 10 to form a reducing zone 15 containing reducing agent 13 within the collection zone 14 of the melt 10. The method illustrated in FIG. 4 may comprise a step for providing the concentrate burner 5 with a reducing agent feeding means 16, wherein the reducing agent feeding means 16 comprising a nozzle 17 that opens into the suspension smelting furnace 1 and a step for feeding the concentrated stream of reducing agent 13 through the nozzle 17 of the reducing agent feeding means 16 onto the surface 9 of the melt 10 to form a reducing zone 15 containing reducing agent 13 within the collection zone 14 of the melt 10.

In a preferred embodiment of the method, the method comprises using a concentrate burner 5 that comprises a pulverous solid matter supply device 18 comprising a feeder pipe 19 for feeding pulverous solid matter 6 into the reaction shaft 2, wherein the feeder pipe 19 has an orifice 20 that opens to the reaction shaft 2;

a dispersing device 21, which is arranged concentrically inside the feeder pipe 19 and which extends to a distance beyond the orifice 20 of the feeder pipe 19 into the reaction shaft 2 and which comprises dispersion gas openings 22 for directing dispersion gas 23 around the dispersing device 21 and to pulverous solid matter 6 that flows around the dispersing device 21; and a gas supply device 24 for feeding reaction gas 7 into the reaction shaft 2, wherein the gas supply device 24 opening to the reaction shaft 2 through an annular discharge orifice 25 that concentrically surrounds the feeder pipe 19 for mixing reaction gas 7 that discharges from the annular discharge orifice 25 with pulverous solid matter 6, which discharges from the orifice 20 of the feeder pipe 19 and which is directed to the side by means of dispersion gas.

In this preferred embodiment of the method, the method comprises feeding pulverous solid matter 6 into the reaction shaft 2 through the orifice 20 of the feeder pipe 19 of the concentrate burner 5;

feeding dispersion gas 23 into the reaction shaft 2 through the dispersion gas openings 22 of the dispersing device 21 of the concentrate burner 5 for directing dispersion gas 23 to pulverous solid matter 6 that flows around the dispersing device 21 to direct pulverous solid matter 6 to the side by means of dispersion gas; and feeding reaction gas 7 into the reaction shaft 2 through the annular discharge orifice 25 of the gas supply device 24 of the concentrate burner 5 for mixing reaction gas 7 with pulverous solid matter 6 which discharges from the middle of the feeder pipe 19 and which is directed to the side by means of dispersion gas 23 to produce suspension 8 of pulverous solid matter 6 and reaction gas 7 in the reaction shaft 2.

This preferred embodiment of the method may comprise using a concentrate burner 5 that comprises a reducing agent feeding means 16 in the form of a central lance 26 that is arranged inside the dispersing device 21 of the concentrate burner 5, wherein the central lance 26 comprising a discharge orifice 27 that opens to the reaction shaft 2; and by feeding a concentrated stream of reducing agent 13 through the discharge orifice 27 of the central lance 26 onto the surface 9 of the melt 10 to form a reducing zone 15 containing reducing agent 13 within the collection zone 14 of the melt 10.

This preferred embodiment of the method may comprise using a concentrate burner 5 that comprises a reducing agent feeding means 16 that is arranged inside the concentrate burner 5, wherein the central lance 26 comprising a discharge orifice 27 that opens to the reaction shaft 2; and by feeding a concentrated stream of reducing agent 13 through the discharge orifice 27 of the central lance 26 onto the surface 9 of the melt 10 to form a reducing zone 15 containing reducing agent 13 within the collection zone 14 of the melt 10. The method may comprise using reducing agent 13 that contains at least one of carbon and sulphide such as coke, coke powder, pulverized biomass, pulverized charcoal, the same pulverous solid matter that is fed by means of the pulverous solid matter supply device 18 of the concentrate burner, ground electronic scrap and/or circuit board chaff.

Reducing agent 13 is preferably, but not necessarily, fed at an initial velocity that is at least the feeding velocity of the reaction gas 7, more preferably at an initial velocity that is at least twice the feeding velocity of the reaction gas 7.

Reaction gas 7 in the form of oxygen enriched gas that has an oxygen content between about 50 and about 100% is preferably, but not necessarily, used in the method.

In the method pulverous solid matter 6 and reaction gas 7 is preferably, but not necessarily, fed into the reaction shaft 2 by means of the concentrate burner 5 so that suspension 8 produced by pulverous solid matter 6 and reaction gas 7 forms a suspension jet 28 in the suspension shaft 2, wherein the suspension jet 28 widens in the reaction shaft 2 in the direction of the lower furnace 3 and wherein the suspension jet 28 has an imaginary vertical central axis 29. If pulverous solid matter 6 and reaction gas 7 by means of the concentrate burner 5 so that a such suspension jet 28 is formed, the method may include directing a concentrated stream of reducing agent 13 essentially in the direction of the imaginary vertical central axis 29 of the suspension jet 28 and in the vicinity to the imaginary vertical central axis 29 of the suspension jet 28 to at least partly prevent reducing agent of the concentrated stream of reducing agent 13 from reacting with reaction gas prior landing on the surface of the melt. In this embodiment reducing agent of the concentrated stream of reducing agent 13 is at least partly prevented from reacting with reaction gas prior landing on the surface of the melt, because the reaction gas content is lower in the vicinity to the imaginary vertical central axis 29 of a such suspension jet 28 than outside the suspension jet.

The method may include forming a concentrated stream of reducing agent by directing a part of the pulverous solid matter that is fed by means of the pulverous solid matter supply device 18 of the concentrate burner towards the middle of the reaction shaft 2 where the reaction gas content is low to prevent at least a part of said part of the pulverous solid matter that is fed by means of the pulverous solid matter supply device 18 of the concentrate burner and that is directed towards the middle of the reaction shaft 2 where the reaction gas content is low to react with reaction gas prior landing on the surface of the melt.

The method may include forming controlling the amount of fed reaction gas 7 to the amount of fed reducing agent 13 to form sub-stoichiometric conditions in the reaction shaft 2 of the suspension smelting furnace. This is preferably done so that first the feeing amount of reducing agent 13 is determined and thereafter the feeding amount of reaction gas 7 is adjusted to form sub-stoichiometric conditions in the reaction shaft 2 of the suspension smelting furnace.

The method may include forming controlling the amount of fed reaction gas 7 to the amount of fed reducing agent 13 to form sub-stoichiometric conditions in the middle of the suspension 8 in the reaction shaft 2 of the suspension smelting furnace. This is preferably done so that first the feeing amount of reducing agent 13 is determined and thereafter the feeding amount of reaction gas 7 is adjusted to form sub-stoichiometric conditions in the middle of the suspension 8 in the reaction shaft 2 of the suspension smelting furnace.

The method may include controlling the amount of fed reaction gas 7 to the amount of fed reducing agent 13 to form over-stoichiometric conditions in the reaction shaft 2 of the suspension smelting furnace. This is preferably done so that first the feeing amount of reducing agent 13 is determined and thereafter the feeding amount of reaction gas 7 is adjusted to form over-stoichiometric conditions in the reaction shaft 2 of the suspension smelting furnace.

The method may include controlling the amount of fed reaction gas 7 to the amount of fed reducing agent 13 to form over-stoichiometric conditions in the middle of the suspension 8 of the reaction shaft 2 of the suspension smelting furnace. This is preferably done so that first the feeing amount of reducing agent 13 is determined and thereafter the feeding amount of reaction gas 7 is adjusted to form over-stoichiometric conditions in the middle of the suspension 8 in the reaction shaft 2 of the suspension smelting furnace.

Next the suspension smelting furnace 1 for suspension smelting of pulverous solid matter 6 and preferred and alternative embodiments of the suspension smelting furnace 1 will be described in greater detail.

The suspension smelting furnace 1 comprises a reaction shaft 2 having a top and a lower end.

The suspension smelting furnace 1 comprises additionally a concentrate burner 5 that comprises a pulverous solid matter supply device 18 for feeding pulverous solid matter 6 and that comprises a gas supply device 24 for feeding reaction gas 7 into the reaction shaft 2 to produce a suspension 8 of pulverous solid matter 6 and reaction gas 7 in the reaction shaft 2, wherein the concentrate burner 5 is located at the top of the reaction shaft 2.

The suspension smelting furnace 1 comprises additionally a lower furnace 3 for collecting suspension 8 in the lower furnace 3 to form a melt 10 having a surface 9, wherein the lower end of the reaction shaft 2 ends in the lower furnace 3 and wherein, when the suspension smelting furnace 1 is in use, suspension 8 that is produced in the reaction shaft 2 and that lands on the surface 9 of the melt 10 in the lower furnace 3 is configured to create a collection zone 14 at the surface 9 of the melt 10 in the lower furnace 3.

The suspension smelting furnace 1 shown in the FIGS. 1 to 5 comprises additionally an uptake 4.

The operating principle of a such suspension smelting furnace is known for example from publication U.S. Pat. No. 6,238,457.

The suspension smelting furnace 1 comprises reducing agent feeding means 16 for feeding additionally to pulverous solid matter 6 and additionally to reaction gas 7 reducing agent 13 into the suspension smelting furnace 1. The reducing agent feeding means 16 are configured for feeding, when the suspension smelting furnace 1 is in use, reducing agent 13 in the form of a concentrated stream of reducing agent 13 through the suspension 8 that is produced in the reaction shaft 2 onto the surface 9 of the melt 10 in the lower furnace 3 to form a reducing zone 15 containing reducing agent 13 in the collection zone 14 of the melt 10 in the lower furnace 3.

The suspension smelting furnace 1 may comprise a reducing agent feeding means 16 in the form of a reducing agent feeding means 16 arranged at least partly inside the suspension smelting furnace 1, wherein the reducing agent feeding means 16 comprises a nozzle 17 that opens into the suspension smelting furnace 1.

The suspension smelting furnace 1 shown in FIG. 1 comprises a reducing agent feeding means 16 for feeding a concentrated stream of reducing agent 13 from the inside of the suspension smelting furnace 1, more precisely a reducing agent feeding means 16 for feeding a concentrated stream of reducing agent 13 from the inside of the lower furnace 3 of the suspension smelting furnace 1. It is possible that suspension smelting furnace 1 comprises a reducing agent feeding means 16 in the form of a reducing agent feeding means 16 arranged at least partly inside the lower furnace 3 of the suspension smelting furnace 1, wherein the reducing agent feeding means 16 comprises a nozzle 17 that opens into the lower furnace 3 of the suspension smelting furnace 1.

The suspension smelting furnace 1 shown in FIG. 2 comprises a reducing agent feeding means 16 for feeding a concentrated stream of reducing agent 13 from the inside of the reaction shaft 2 of the suspension smelting furnace 1. It is possible that suspension smelting furnace 1 comprises a reducing agent feeding means 16 in the form of a reducing agent feeding means 16 arranged at least partly inside the reaction shaft 2 of the suspension smelting furnace 1, wherein the reducing agent feeding means 16 comprises a nozzle 17 that opens into the reaction shaft 2 of the suspension smelting furnace 1.

The suspension smelting furnace 1 shown in FIG. 3 comprises a reducing agent feeding means 16 for feeding a concentrated stream of reducing agent 13 inside the suspension smelting furnace 1 from the top of reaction shaft 2 of the suspension smelting furnace 1. It is possible that the suspension smelting furnace 1 comprises a reducing agent feeding means 16 in the form of a reducing agent feeding means 16 arranged at the top of the reaction shaft 2 of the suspension smelting furnace 1, wherein the reducing agent feeding means 16 comprises a nozzle 17 that opens into the reaction shaft 2 of the suspension smelting furnace 1 at the top of the reaction shaft 2.

In the suspension smelting furnace 1 shown in FIG. 4 the concentrate burner 5 is provided with a reducing agent feeding means 16 for feeding a concentrated stream of reducing agent 13.

In a preferred embodiment of the suspension smelting furnace 1 the concentrate burner 5 comprises a pulverous solid matter supply device 18 comprising a feeder pipe 19 for feeding pulverous solid matter 6 into the reaction shaft 2, wherein the feeder pipe 19 has an orifice 20 that opens to the reaction shaft 2;

a dispersing device 21, which is arranged concentrically inside the feeder pipe 19 and which extends to a distance beyond the orifice 20 of the feeder pipe 19 into the reaction shaft 2 and which comprises dispersion gas openings 22 for directing dispersion gas 23 around the dispersing device 21 and to pulverous solid matter 6 that flows around the dispersing device 21; and a gas supply device 24 for feeding reaction gas 7 into the reaction shaft 2, wherein the gas supply device 24 opens to the reaction shaft 2 through an annular discharge orifice 25 that concentrically surrounds the feeder pipe 19 for mixing reaction gas 7 that discharges from the annular discharge orifice 25 with pulverous solid matter 6, which discharges from the orifice 20 of the feeder pipe 19 and which is directed to the side by means of dispersion gas 23 to produce suspension 8 of pulverous solid matter 6 and reaction gas 7 in the reaction shaft 2. In this preferred embodiment of the suspension smelting furnace 1 the concentrate burner 5 may comprise a reducing agent feeding means 16 in the form of a central lance 26 that is arranged inside the dispersing device 21 of the concentrate burner 5, wherein the central lance 26 comprising a discharge orifice 27 that opens to the reaction shaft 2.

The suspension smelting furnace 1 may comprise a reducing agent feeding means 16 for feeding a concentrated stream of reducing agent 13 that contains at least one of carbon and sulphide such as coke, coke powder, pulverized biomass, pulverized charcoal, the same pulverous solid matter that is fed by means of the pulverous solid matter supply device 18 of the concentrate burner, ground electronic scrap and/or circuit board chaff.

The suspension smelting furnace 1 may comprise a reducing agent feeding means 16 for feeding reducing agent 13 at an initial velocity that is at least the feeding velocity of the reaction gas 7, preferably at an initial velocity that is at least twice the feeding velocity of the reaction gas 7.

The suspension smelting furnace 1 may comprise a gas supply device 24 for feeding as reaction gas 7 oxygen enriched gas that has an oxygen content between about 50 and about 100%.

The concentrate burner 5 of the suspension smelting furnace may be arranged for feeding pulverous solid matter 6 and reaction gas 7 into the reaction shaft 2 so that suspension 8 produced by pulverous solid matter 6 and reaction gas 7 forms a suspension jet 28 in the suspension shaft 2, which the suspension jet 28 widens in the reaction shaft 2 in the direction of the lower furnace 3 and which the suspension jet has an imaginary vertical central axis 29. In this case, the suspension smelting furnace 1 may comprise a reducing agent feeding means 16 for feeding a concentrated stream of reducing agent 13 essentially in the direction of the imaginary vertical central axis 29 of the suspension jet 28 and in the vicinity to the imaginary vertical central axis 29 of the suspension jet 28 to at least partly prevent reducing agent of the concentrated stream of reducing agent from reacting with reaction gas prior landing on the surface of the melt.

The suspension smelting furnace 1 may comprise a reducing agent feeding means 16 for feeding a concentrated stream of reducing agent by forming a concentrated stream of reducing agent by directing a part of the pulverous solid matter that is fed by means of the pulverous solid matter supply device 18 of the concentrate burner towards the middle of the reaction shaft 2 where the reaction gas content is low to prevent at least a part of said part of the pulverous solid matter that is fed by means of the pulverous solid matter supply device 18 of the concentrate burner and that is directed towards the middle of the reaction shaft 2 where the reaction gas content is low to react with reaction gas prior landing on the surface of the melt.

The suspension smelting furnace 1 may comprise controlling means for controlling the amount of fed reaction gas 7 to the amount of fed reducing agent 13 to form substoichiometric conditions in the suspension smelting furnace.

The suspension smelting furnace 1 may comprise controlling means for controlling the amount of fed reaction gas 7 to the amount of fed reducing agent 13 to form substoichiometric conditions in the middle of the suspension 8 in the reaction shaft 2 of the suspension smelting furnace.

The suspension smelting furnace 1 may comprise controlling means for controlling the amount of fed reaction gas 7 to the amount of fed reducing agent 13 to form overstoichiometric conditions in the suspension smelting furnace.

The suspension smelting furnace 1 may comprise controlling means for controlling the amount of fed reaction gas 7 to the amount of fed reducing agent 13 to form overstoichiometric conditions in the middle of the suspension 8 in the reaction shaft 2 of the suspension smelting furnace. Next the concentrate burner 5 for feeding reaction gas 7 and pulverous solid matter 6 into the reaction shaft 2 of suspension smelting furnace 1 and preferred and alternative embodiments of the concentrate burner 5 will be described in greater detail.

The concentrate burner 5 comprises a pulverous solid matter supply device 18 comprising a feeder pipe 19 for feeding pulverous solid matter 6 into the reaction shaft 2, wherein the feeder pipe 19 has an orifice 20 that opens to the reaction shaft 2.

The concentrate burner 5 comprises additionally a dispersing device 21, which is arranged concentrically inside the feeder pipe 19 and which extends to a distance beyond the orifice 20 of the feeder pipe 19 into the reaction shaft 2 and which comprises dispersion gas openings 22 for directing dispersion gas 23 around the dispersing device 21 and to pulverous solid matter 6 that flows around the dispersing device 21.

The concentrate burner 5 comprises additionally a gas supply device 24 for feeding reaction gas 7 into the reaction shaft 2 wherein the gas supply device 24 opens to the reaction shaft 2 through an annular discharge orifice 25 that concentrically surrounds the feeder pipe 19 for mixing reaction gas 7 that discharges from the annular discharge orifice 25 with pulverous solid matter 6, which discharges from the orifice 20 of the feeder pipe 19 and which is directed to the side by means of dispersion gas 23 to produce suspension 8 of pulverous solid matter 6 and reaction gas 7 in the reaction shaft 2.

The concentrate burner 5 is provided with a reducing agent feeding means 16 for feeding a concentrated stream of reducing agent 13.

Figure 7:
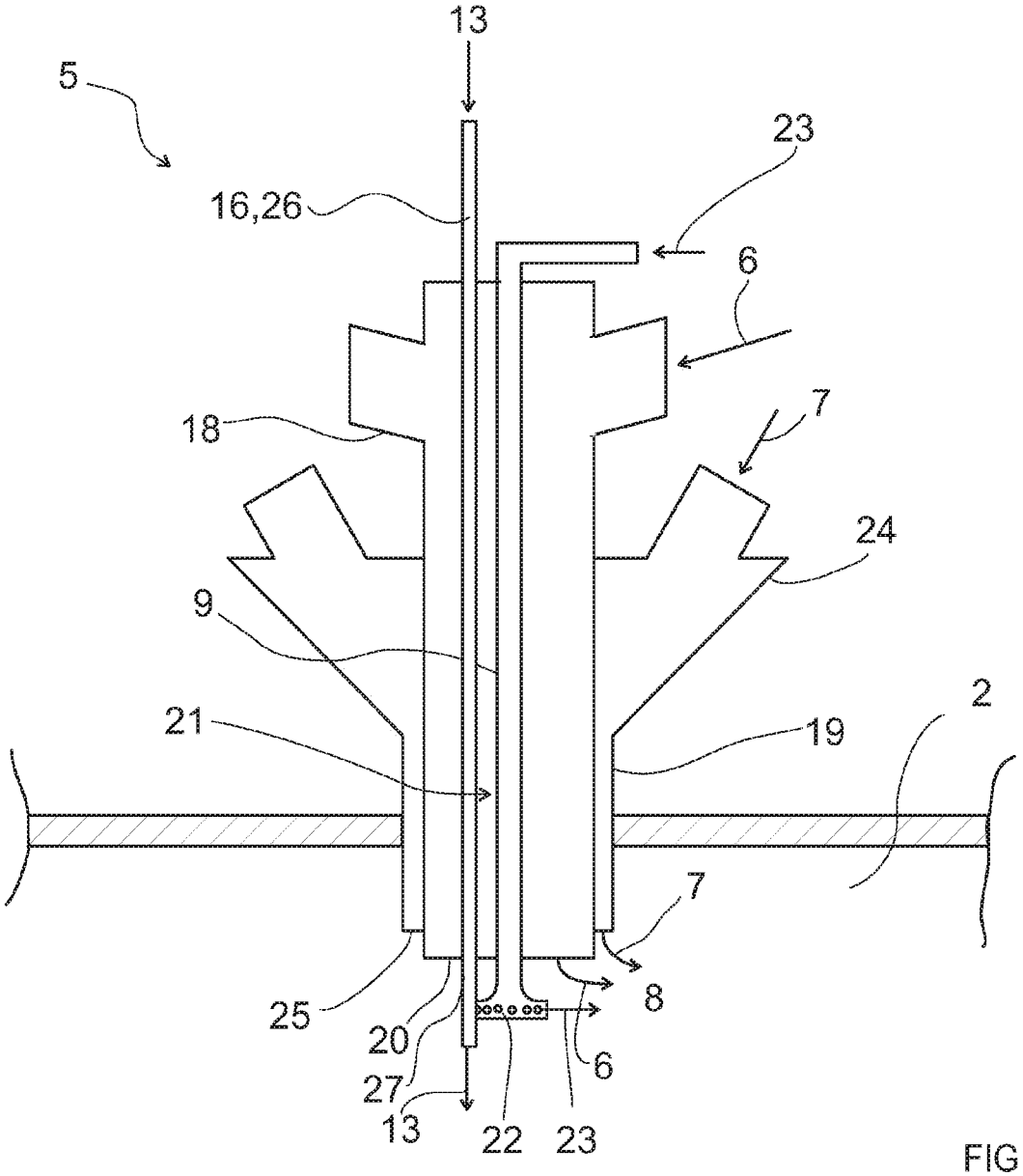
FIG. 7 is a schematic representation of a concentrate burner for a suspension smelting furnace according to a second preferred embodiment.

The concentrate burner 5 may comprise, as shown in FIG. 7, a reducing agent feeding means 16 in the form of a central lance 26 that is arranged inside the dispersing device 21 of the concentrate burner 5, wherein the central lance 26 comprising a discharge orifice 27 that opens to the reaction shaft 2.

The concentrate burner 5 may comprise, as shown in FIG. 8, a reducing agent feeding means 16 in the form of a reducing agent feeding means 16, wherein the reducing agent feeding means 16 comprises a nozzle 17 that opens into the reaction shaft 2 of the suspension smelting furnace 1.

The invention also relates to a concentrate burner 5 for use in a method according to the invention or in a suspension smelting furnace 1 according to the invention.

The concentrate burner 5 comprises a pulverous solid matter supply device 18 comprising a feeder pipe 19 for feeding pulverous solid matter 6 into the reaction shaft 2, wherein the feeder pipe 19 has an orifice 20 that opens to the reaction shaft.

The concentrate burner 5 comprises additionally a dispersing device 21, which is arranged concentrically inside the feeder pipe 19 and which extends to a distance beyond the orifice 20 of the feeder pipe 19 into the reaction shaft 2 and which comprises dispersion gas openings 22 for directing dispersion gas 23 around the dispersing device 21 and to pulverous solid matter 6 that flows around the dispersing device 21.

The concentrate burner 5 comprises additionally a gas supply device 24 for feeding reaction gas 7 into the reaction shaft 2 wherein the gas supply device 24 opens to the reaction shaft 2 through an annular discharge orifice 25 that concentrically surrounds the feeder pipe 19 for mixing reaction gas 7 that discharges from the annular discharge orifice 25 with pulverous solid matter 6, which discharges from the orifice 20 of the feeder pipe 19 and which is directed to the side by means of dispersion gas 23 to produce suspension 8 of pulverous solid matter 6 and reaction gas 7 in the reaction shaft 2.

The concentrate burner 5 is provided with a reducing agent feeding means 16 for feeding a concentrated stream of reducing agent 13.

The concentrate burner 5 may comprise, as shown in FIG. 7, a reducing agent feeding means 16 in the form of a central lance 26 that is arranged inside the dispersing device 21 of the concentrate burner 5, wherein the central lance 26 comprising a discharge orifice 27 that opens to the reaction shaft 2.

The concentrate burner 5 may comprise, as shown in FIG. 8, a reducing agent feeding means 16 in the form of a reducing agent feeding means 16, wherein the reducing agent feeding means 16 comprising a nozzle 17 that opens into the reaction shaft 2 of the suspension smelting furnace 1.

It is apparent to a person skilled in the art that as technology advances, the basic idea of the invention can be implemented in various ways. The invention and its embodiments are therefore not restricted to the above examples, but they may vary within the scope of the claims.

The invention claimed is:

1. A suspension smelting furnace for suspension smelting of pulverous solid matter, wherein the suspension smelting furnace comprises:

a reaction shaft having an elongated vertical configuration and ending in a lower end, a lower furnace having an elongated horizontal configuration and that is in communication with and adjoins the lower end of the reaction shaft and a concentrate burner at the top of the reaction shaft, the concentrate burner comprises a pulverous solid matter supply device for feeding pulverous solid matter into the reaction shaft and comprises a gas supply device for feeding reaction gas into the reaction shaft, the concentrate burner being configured to feed pulverous solid matter and reaction gas into the reaction shaft to produce a suspension of pulverous solid matter and reaction gas in the reaction shaft, the lower furnace being configured to collect suspension on the surface of a melt in the lower furnace so that suspension that lands on the surface creates a collection zone at the surface of the melt in the lower furnace, the lower furnace further having a roof structure with a feed opening adjoining an open lower end of the reaction shaft, the suspension smelting furnace being configured to receive additionally to pulverous solid matter and additionally to reaction gas reducing agent from a reducing agent feeder, the reaction shaft being configured to receive fed pulverous solid matter and reaction gas into the reaction shaft by means of the concentrate burner so that suspension produced by pulverous solid matter and reaction gas forms a suspension jet in a suspension shaft, wherein the suspension jet widens in the reaction shaft in the direction of the lower furnace and wherein the suspension jet has an imaginary vertical central axis, and the suspension smelting furnace is capable of receiving the reducing agent in the form of a concentrated stream of reducing agent fed from the reducing agent feeder through the suspension in the suspension smelting furnace onto the surface of the melt to form a reducing zone containing the reducing agent within the collection zone of the melt, and wherein the reducing agent is fed at an initial velocity that is at least the feeding velocity of the reaction gas, the reducing agent feeder being configured so that a concentrated stream of reducing agent is directed from the reducing agent feeder essentially in the direction of an imaginary vertical central axis of the suspension jet and in the vicinity to the imaginary vertical central axis of the suspension jet to prevent reducing agent of the concentrated stream of reducing agent from reacting with reaction gas prior landing on the surface of the melt, wherein the reducing agent feeder is configured to feed the concentrated stream of reducing agent from the inside the lower furnace of the suspension smelting furnace.

2. The suspension smelting furnace according to claim 1, wherein the concentrate burner comprising a pulverous solid matter supply device comprising a feeder pipe for feeding pulverous solid matter into the reaction shaft, wherein the feeder pipe has an orifice that opens to the reaction shaft, a dispersing device, which is arranged concentrically inside the feeder pipe and which extends to a distance beyond the orifice of the feeder pipe into the reaction shaft and which comprises dispersion gas openings for directing dispersion gas around the dispersing device and to pulverous solid matter that flows around the dispersing device; and a gas supply device for feeding reaction gas into the reaction shaft, wherein the gas supply device opening to the reaction shaft through an annular discharge orifice that concentrically surrounds the feeder pipe for mixing reaction gas that discharges from the annular discharge orifice with pulverous solid matter, which discharges from the orifice of the feeder pipe and which is directed to the side by means of dispersion gas to produce suspension of pulverous solid matter and reaction gas in the reaction shaft.

3. The suspension smelting furnace according to claim 1, including a controller configured to control the amount of fed reaction gas to the amount of fed reducing agent to form sub-stoichiometric conditions in the middle of the suspension of the suspension smelting furnace.

4. The suspension smelting furnace according to claim 1, including a controller configured to control the amount of fed reaction gas to the amount of fed reducing agent to form stoichiometric or over-stoichiometric conditions in the middle of the suspension of the suspension smelting furnace.

* * * * *